US008899569B2

(12) United States Patent
Soga

(10) Patent No.: US 8,899,569 B2
(45) Date of Patent: Dec. 2, 2014

(54) SHEET PROCECESSING APPARATUS

(71) Applicants: Kabushiki Kaisha Toshiba, Tokyo (JP); Toshiba Tec Kabushiki Kaisha, Tokyo (JP)

(72) Inventor: Naofumi Soga, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/957,170

(22) Filed: Aug. 1, 2013

(65) Prior Publication Data

US 2014/0035217 A1 Feb. 6, 2014

(30) Foreign Application Priority Data

Aug. 1, 2012 (JP) ..... 2012-170734

(51) Int. Cl.

| | |
|---|---|
| ***B65H 31/34*** | (2006.01) |
| ***B65H 39/00*** | (2006.01) |
| ***B65H 9/10*** | (2006.01) |
| ***B65H 9/00*** | (2006.01) |
| ***B65H 29/34*** | (2006.01) |
| ***B65H 29/52*** | (2006.01) |
| ***B65H 31/30*** | (2006.01) |
| ***B65H 39/10*** | (2006.01) |

(52) U.S. Cl.

CPC ..... *B65H 39/00* (2013.01); *B65H 9/10* (2013.01); *B65H 9/00* (2013.01); *B65H 2301/3621* (2013.01); *B65H 29/34* (2013.01); *B65H 29/52* (2013.01); *B65H 31/3018* (2013.01); *B65H 31/3081* (2013.01); *B65H 31/34* (2013.01); *B65H 39/10* (2013.01); *B65H 2301/4213* (2013.01); *B65H 2404/61* (2013.01); *B65H 2404/693* (2013.01); *B65H 2511/12* (2013.01); *B65H 2511/20* (2013.01); *B65H 2801/27* (2013.01)

USPC ..... 270/58.17; 270/58.07; 270/58.12; 270/58.27; 270/58.11

(58) Field of Classification Search

CPC ..... B65H 9/00; B65H 9/04; B65H 9/10; B65H 31/34; B65H 2301/3621

USPC ..... 270/58.07, 58.08, 58.11, 58.12, 58.17, 270/58.27

See application file for complete search history.

(56) References Cited

U.S. PATENT DOCUMENTS

| | | | | |
|---|---|---|---|---|
| 6,209,864 | B1 * | 4/2001 | Taniguchi et al. | 271/220 |
| 6,352,253 | B1 * | 3/2002 | Hayakawa et al. | 270/58.12 |
| 6,889,971 | B2 * | 5/2005 | Tamura et al. | 270/58.11 |

(Continued)

FOREIGN PATENT DOCUMENTS

| | | | |
|---|---|---|---|
| JP | H05-238621 | | 9/1993 |
| JP | 10194555 | A * | 7/1998 |

(Continued)

OTHER PUBLICATIONS

Office Action dated Jun. 17, 2014, filed in corresponding Japanese Patent Application No. 2012-170734, with English translation.

*Primary Examiner* — Leslie A Nicholson, III

(74) *Attorney, Agent, or Firm* — Patterson & Sheridan LLP

(57) ABSTRACT

A sheet processing apparatus according to an embodiment comprises a processing tray configured to receive sheets to be processed, the processing tray having an ejecting side from which sheets are ejected, and a loading tray provided downstream from the processing tray in a sheet ejecting direction and configured to receive sheets ejected from the processing tray. The sheet processing apparatus further comprises a bending restrainer including a restraining member extending almost parallel to the processing tray and covering a portion of the ejecting side of the processing tray, the restraining member configured to restrain bending of sheets ejected from the processing tray to the loading tray.

20 Claims, 17 Drawing Sheets

(56) References Cited

U.S. PATENT DOCUMENTS

| | | | | |
|---|---|---|---|---|
| 6,926,267 | B2 * | 8/2005 | Kobayashi | 271/3.14 |
| 6,991,226 | B2 * | 1/2006 | Kimura et al. | 270/58.09 |
| 7,547,009 | B2 * | 6/2009 | Isobe et al. | 270/58.11 |
| 7,624,976 | B2 * | 12/2009 | Koie | 270/58.12 |
| 7,862,026 | B2 * | 1/2011 | Terao et al. | 270/58.12 |
| 7,922,164 | B2 * | 4/2011 | Nakayama | 270/58.12 |
| 8,162,306 | B2 * | 4/2012 | Suzuki et al. | 270/58.12 |
| 8,246,034 | B2 * | 8/2012 | Tsuchiya | 270/58.12 |
| 2010/0150636 | A1 | 6/2010 | Kubota et al. | |
| 2011/0215513 | A1 | 9/2011 | Soga | |
| 2011/0215515 | A1 | 9/2011 | Soga et al. | |
| 2013/0049280 | A1 | 2/2013 | Soga et al. | |

FOREIGN PATENT DOCUMENTS

| | | |
|---|---|---|
| JP | 2002-321868 | 11/2002 |
| JP | 2005-206310 | 8/2005 |
| JP | 2007-076893 | 3/2007 |

* cited by examiner

SHEET PROCECESSING APPARATUS

CROSS-REFERENCE TO RELATED APPLICATION

This application is based upon and claims the benefit of priority from Japanese Patent Application No. 2012-170734, filed Aug. 1, 2012, the entire contents of which is incorporated herein by reference.

FIELD

Embodiments described herein relate generally to a sheet processing apparatus.

BACKGROUND

A sheet processing apparatus may be provided downstream of an image forming device such as a copier, printer, or MFP (multi-functional peripheral) to perform post-processes such as sorting and stapling of printed sheets.

In such an apparatus, a sheet fed from a main body of an image-forming apparatus is received by a processing tray and stapled at the end of a bundle of the sheets on the processing tray. A movable loading tray capable of loading sheets or a bundle of sheets is provided at the downstream side in the conveying direction of the processing tray. The loading tray moves up and down depending on the loading amount. Sheets and a bundle of sheets subject to a post-processing such as stapling on the processing tray are ejected from the processing tray to the loading tray and then loaded on the loading tray. A plurality of sheets or a plurality of bundles of sheets is loaded on the loading tray sequentially by repeating such a process.

A force to eject from a processing tray to a loading tray is applied to a bundle of sheets that is being ejected. However, a friction occurs between the forward end of a bundle of sheets being ejected and a sheet on a loading tray, upon contacting the forward end of a sheet ejected from a processing tray to the top face of a sheet loaded on a loading tray. Therefore, the bundle of sheets may bend upwards in a convex state in the middle of ejecting, if the bundle of sheets comprises thin and frail sheets or a larger size of sheets. Incidence of a large bending of a bundle of sheets in the middle of ejection can lead to aligning trouble in which a position of a bundle of sheets cannot be aligned on a loading tray. Also, it may lead to ejection trouble in which the back end of the bended bundle of sheets remains on the processing tray.

Thus, a sheet processing apparatus that has fewer incidences of such aligning trouble and ejection trouble is desired.

DETAILED DESCRIPTION

A sheet processing apparatus according to an embodiment comprises a processing tray configured to receive sheets to be processed, the processing tray having an ejecting side from which sheets are ejected, and a loading tray provided downstream from the processing tray in a sheet ejecting direction and configured to receive sheets ejected from the processing tray. The sheet processing apparatus further comprises a bending restrainer including a restraining member extending almost parallel to the processing tray and covering a portion of the ejecting side of the processing tray, the restraining member configured to restrain bending of sheets ejected from the processing tray to the loading tray.

Hereafter, embodiments will be described with reference to the attached drawings.

(1) Configuration

Figure 1:
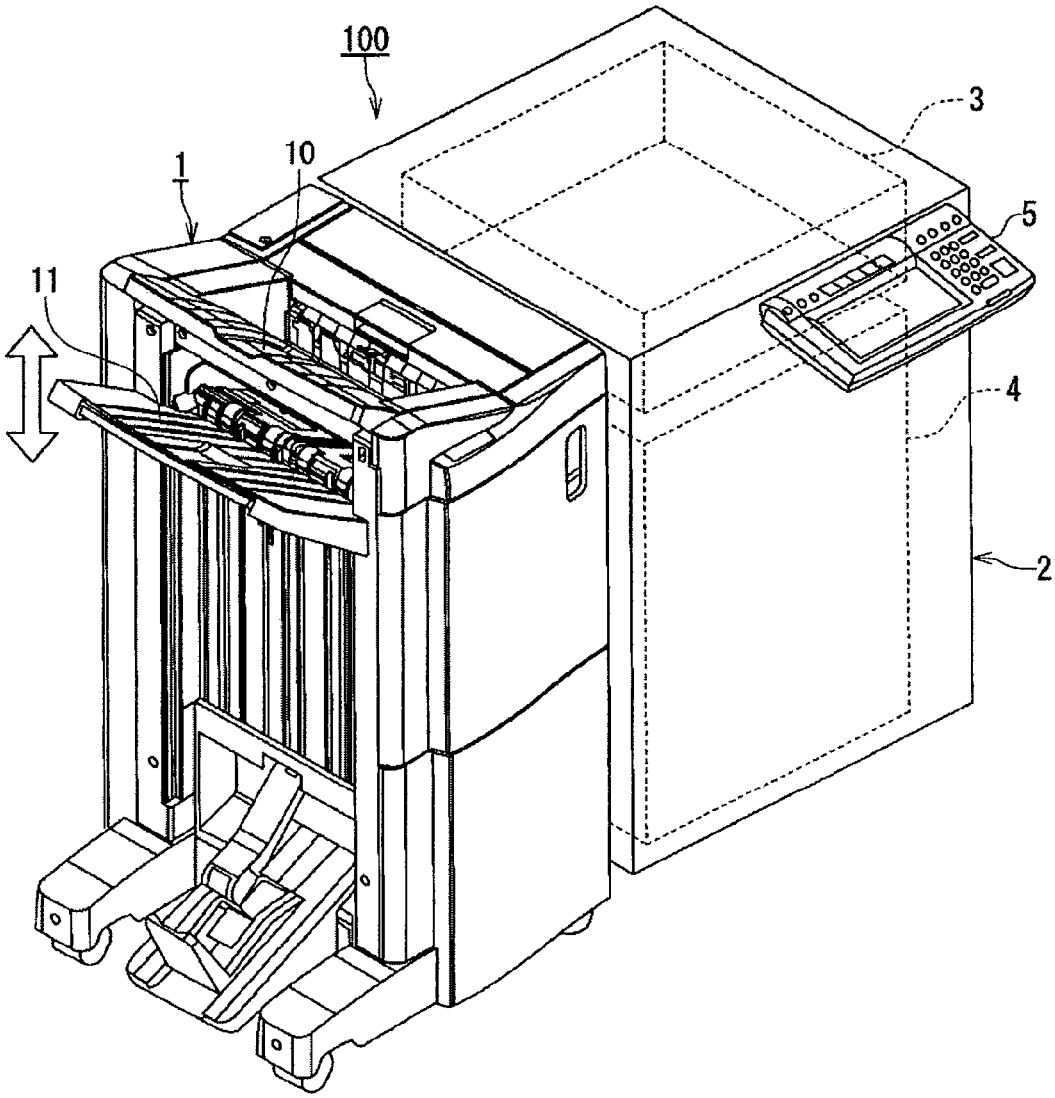
FIG. 1 is a perspective view illustrating a sheet processing apparatus, according to an embodiment.

FIG. 1 is a perspective view of an image-forming apparatus 100 including a sheet processing apparatus 1 relating to the present embodiment. The image-forming apparatus 100 includes a main body 2 and a sheet processing apparatus 1 arranged adjacent to the main body 2.

The main body 2 includes a scanner 3 that reads a document and a printer 4 that prints the scanned image by the scanner 3 to a sheet. A control panel 5 having a display panel and diverse operation keys is also provided on the main body 2.

The sheet processing apparatus 1 includes a fixed tray 10 that ejects and loads a printed sheet in the main body 2, and a movable loading tray 11 that moves up and down as illustrated with arrows and loads a large amount of printed sheets. The sheet processing apparatus 1 has a function of sorting a plurality of printed sheets (i.e., a bundle of sheets) and stapling sheets.

Figure 2:
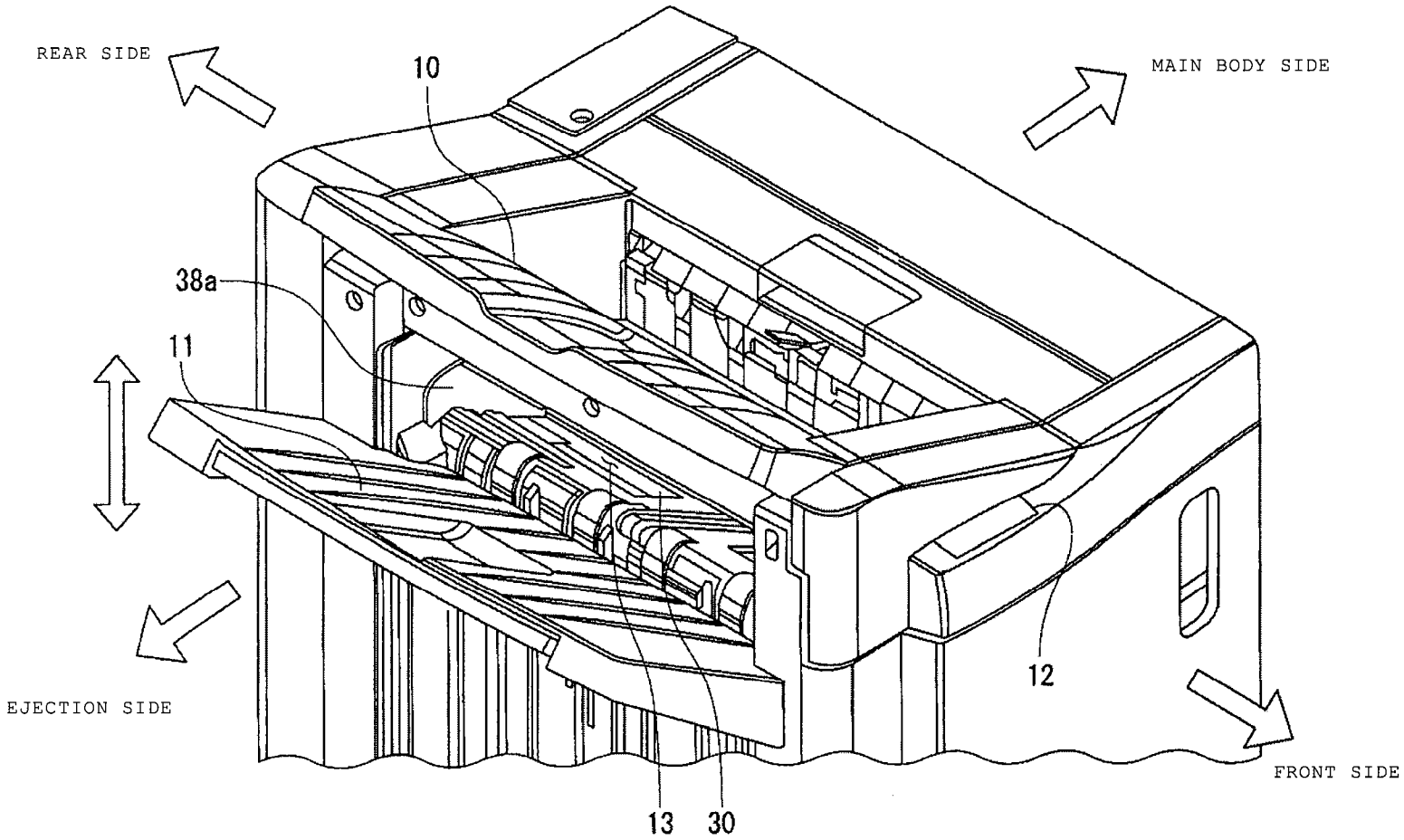
FIG. 2 is a magnified perspective view of a top portion of the sheet processing apparatus, according to the embodiment.

FIG. 2 is a magnified perspective view of a top portion of the sheet processing apparatus 1. As illustrated with arrows in FIG. 2, the direction that a sheet or a bundle of sheets is ejected is the ejecting side, the direction that the main body 2 is arranged is the main body side, the right side viewing from the ejecting side to the main body side is the front side, and the left side is the rear side.

An outlet 13 is located between a fixed tray 10 and a loading tray 11. A sheet loaded on the loading tray 11 (or a bundle of sheets) is ejected from the outlet 13. A processing tray 30 is provided underneath the outlet 13, which will be described later. Side aligning plates 38*a*, 38*b* are provided at the rear side and the front side of the processing tray 30. Only the side aligning plate 38*a* at the rear side is visible in FIG. 2.

Figure 3:
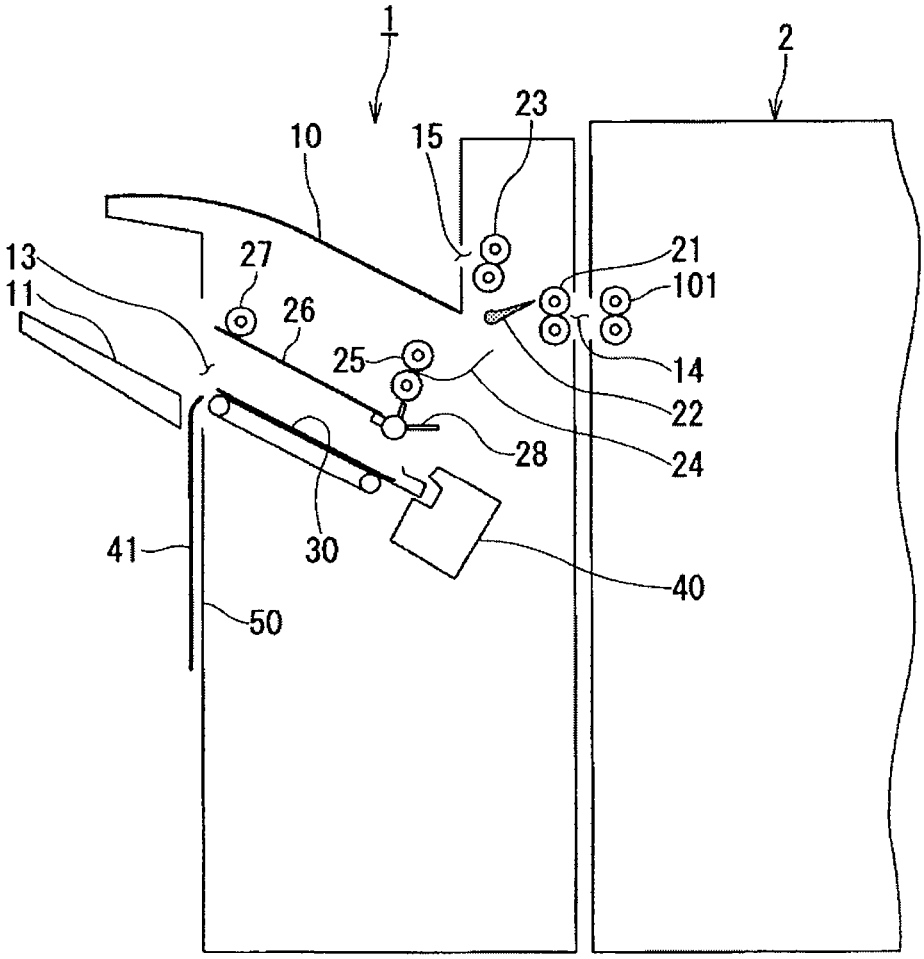
FIG. 3 is a cross-sectional view illustrating a configuration of the sheet processing apparatus, according to the embodiment.

FIG. 3 is a cross-sectional view illustrating a configuration of the sheet processing apparatus 1. An entrance roller 21 is provided at the opposite position of an exit roller 101 of the main body 2. A gate flap 22 is positioned downstream from the entrance roller 21. A fixed tray roller 23 is provided over the gate flap 22. A conveying guide plate 24, which bends downward, and a conveying roller 25 are provided beneath the gate flap 22. A standby tray 26 is arranged downstream of the conveying roller 25.

As illustrated in FIG. 3, the standby tray 26 is inclined so that the height of the main body side end is lower than the height of the ejection side end. A buffer roller 27 is provided in the vicinity of the tip of the ejection side of the standby tray 26. A paddle 28 is provided in the vicinity of the main body side of the standby tray.

Figure 4:
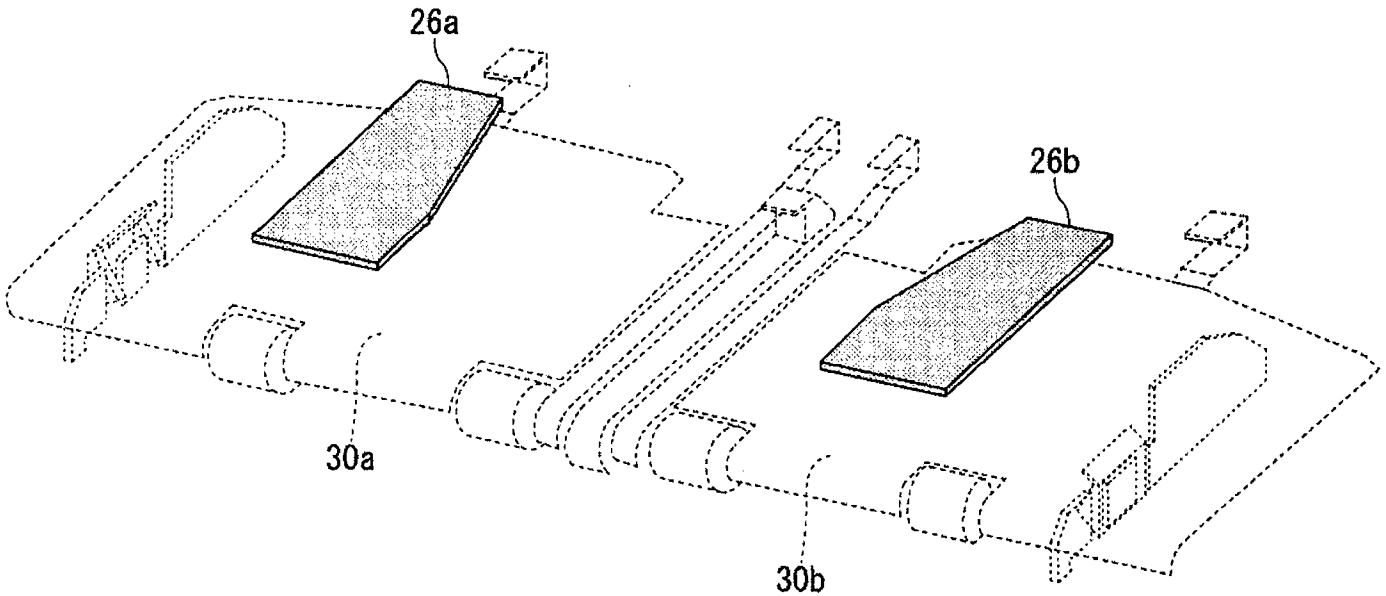
FIG. 4 illustrates positions of a standby tray and a processing tray, according to the embodiment.

FIG. 4 is a perspective view illustrating the structure of the standby tray 26 schematically. In FIG. 4, the standby tray 26 is shaded, and the processing tray 30 underneath the standby tray 26 is shown with dotted lines. The standby tray 26 comprises a standby tray 26*a* at the rear side and a standby tray 26*b* at the front side. The standby trays 26*a*, 26*b* are capable of opening and closing toward the direction of front/rear by a driving mechanism (not shown), as described later.

The processing tray 30 is arranged underneath the standby tray 26. Similar to the standby tray 26, the processing tray 30 is inclined so that the height of the main body side end is lower than the height of the ejection side end. A shutter 41 is provided along with an ejection side outer wall 50 of the sheet processing apparatus 1 between the processing tray 30 and the loading tray 11. A stapler 40 is arranged beyond the main body side of the processing tray 30.

Figure 5:
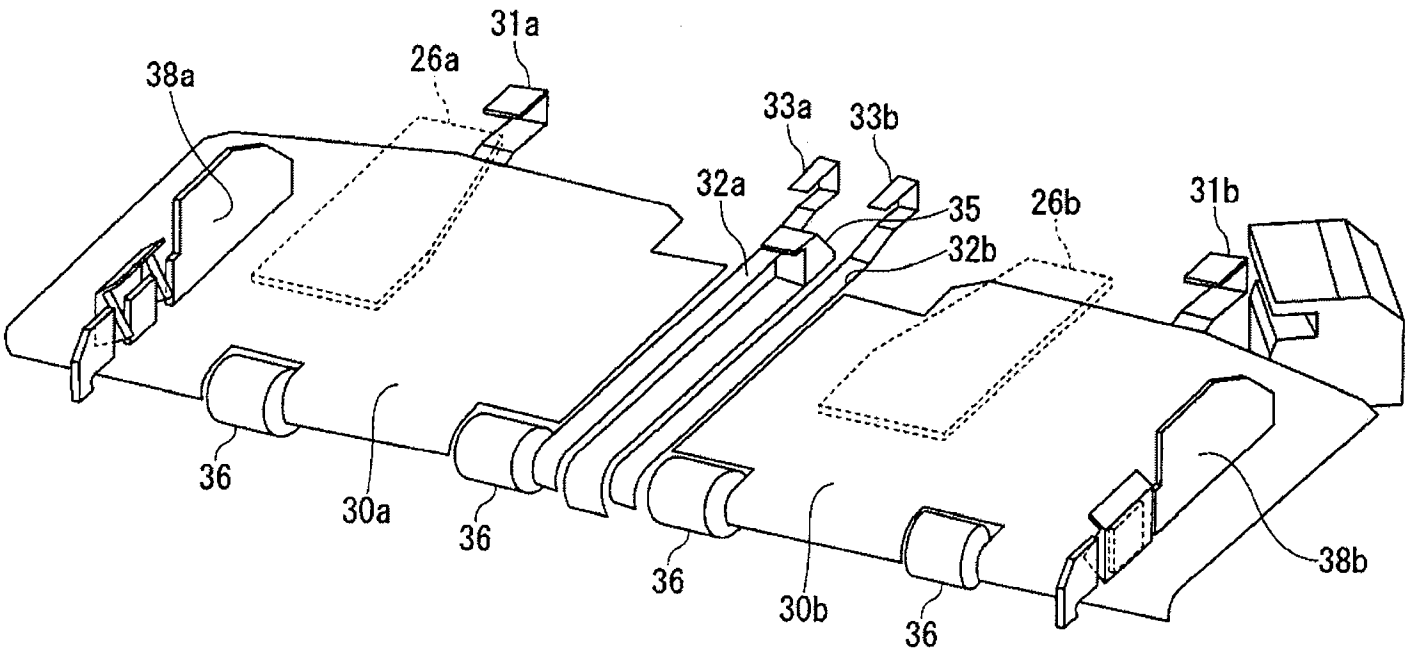
FIG. 5 illustrates a detail the processing tray, according to the embodiment.

FIG. 5 illustrates a configuration of the processing tray 30 and the surrounding area. The processing tray 30 is divided into two processing trays 30*a*, 30*b*, which are separated at the center. Back stoppers 31*a*, 31*b* are provided at the end portion of the main body side of the processing trays 30*a*, 30*b*. Four sheet bundle conveying rollers 36 are provided at the end portion of the ejection side.

A bundle claw belt 34 and ejection belts 32*a*, 32*b* are arranged adjacent to each other at the divided portion of the processing tray 30.

A bundle claw 35 is anchored at the outer periphery of the bundle claw belt 34. The bundle claw belt 35 rotates so as to move the bundle claw 35 from the main body side toward the ejection side at the surface of the processing tray 30, and to return the bundle claw 35 from the ejection side to the main body side at the back side of the processing tray 30.

Ejectors 33*a*, 33*b* are anchored at the outer periphery of the ejection belts 32*a*, 32*b*, respectively. The ejection belts 32*a*, 32*b* are interlinked with the same driving source as the bundle claw belt 34 by an electromagnetic clutch (not shown). The ejection belts 32*a*, 32*b* move the ejectors 33*a*, 33*b* to the vicinity of the center portion of the processing tray 30 in near synchronization with a movement of the bundle claw 35. After that, the electromagnetic clutch is turned off, and then the ejectors 33*a*, 33*b* are pulled back to the position indicated in FIG. 5 (home position of the ejectors) by an elastic force of a spring. Thus, the ejectors 33*a*, 33*b* conduct a reciprocating movement on the processing tray 30. A home position of the ejectors 33*a*, 33*b* and the back stoppers 31*a*, 31*b* are at nearly the same location.

The side aligning plates 38*a*, 38*b* are provided on the processing trays 30*a*, 30*b*, respectively. The side aligning plates 38*a*, 38*b* are configured so as to be capable of moving rear/front directions by a driving mechanism. Each side of aligning plate 38*a*, 38*b* has a bending restrainer 100 hereinafter described.

A stapler 40 is provided at the main body side of the processing tray 30. The stapler 40 is used when automatically stapling a bundle of sheets printed in the main body 2.

(2) Operation

An operation of the sheet processing apparatus 1 configured as above is now described. There is a simple operation mode for simply ejecting a printed sheet and loading to the fixed tray 10 or to the loading tray 11, and an operation mode in which stapling and sorting are first conducted on the processing tray 30 and then ejecting to the loading tray 11 to load. In the former simple operation, a user can choose the fixed tray 10 or the loading tray 11 as an ejecting target. The loading tray 11 comes down as number of loading pieces increases and is capable of loading many (for example, 2,000 pieces or more) sheets. Thus, when a large number of sheets are printed, a user will choose the loading tray 11 as an ejecting target.

On the other hand, the loading tray 11 will be selected by the apparatus as an ejecting target for the post-processed sheets (or bundle of sheets) if the user chooses an operation mode in which stapling and sorting are conducted. An operation mode in which stapling and sorting are conducted and then ejecting and loading a sheet to the loading tray 11 will be described hereafter with reference to FIGS. 6 to 8.

Figure 6:
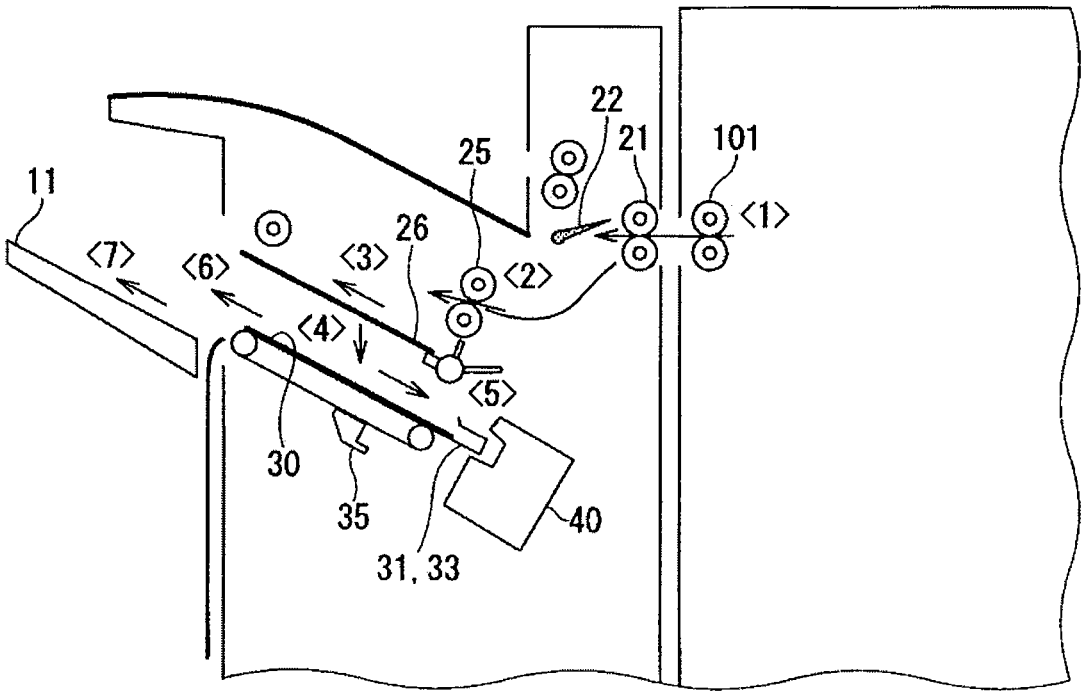
FIG. 6 illustrates flow of a sheet from the processing tray to a loading tray, according to the embodiment.
Figure 7A:
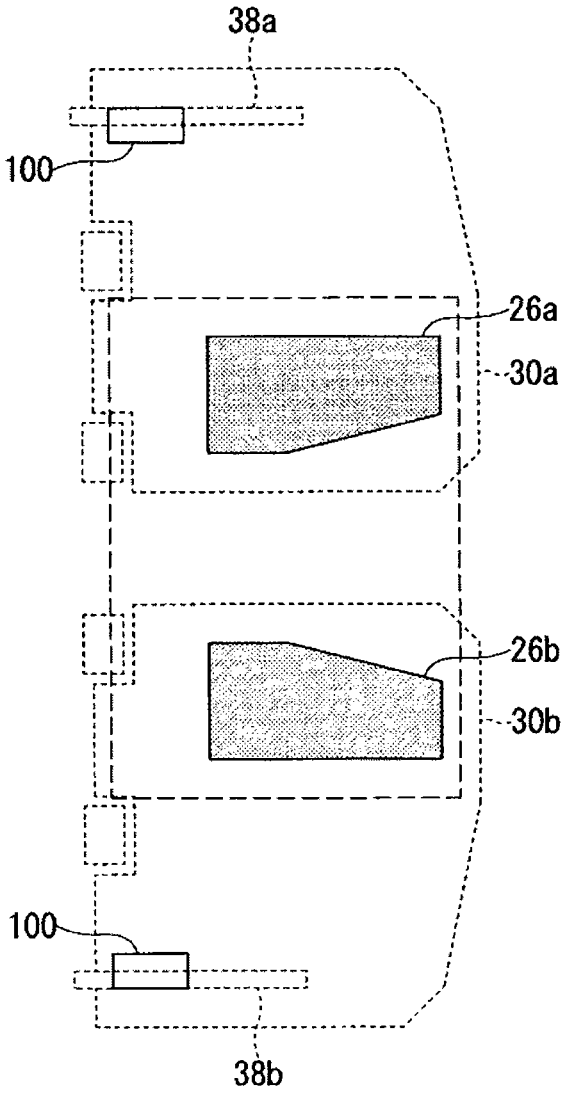
FIGS. 7A to 7D illustrate an operation of a sheet dropping from the standby tray to the processing tray, according to the embodiment.
Figure 7B:
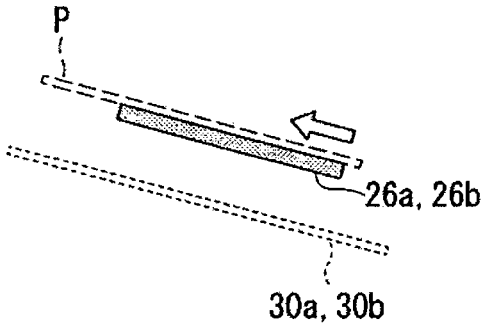

FIG. 6 illustrates the outline of a sheet flow by numbers from <1> to <7>. First, a sheet printed in the main body 2 is drawn from the exit roller 101 by the entrance roller 21 of the sheet processing apparatus 1 <1>). Then the sheet moves downward along with the gate flap 22 (<2>). Then the sheet is loaded once on the standby tray 26 (<3>). At this point, the standby trays 26*a*, 26*b* are closed as illustrated in FIG. 7A. When closed, a gap between the standby trays 26*a* and 26*b* varies depending on the size of a sheet. The gap between the standby trays 26*a* and 26*b* is such that the sheet P will not fall directly to the processing tray 30 and is instead first caught by the standby tray 26 (FIG. 7B).

Figure 7C:
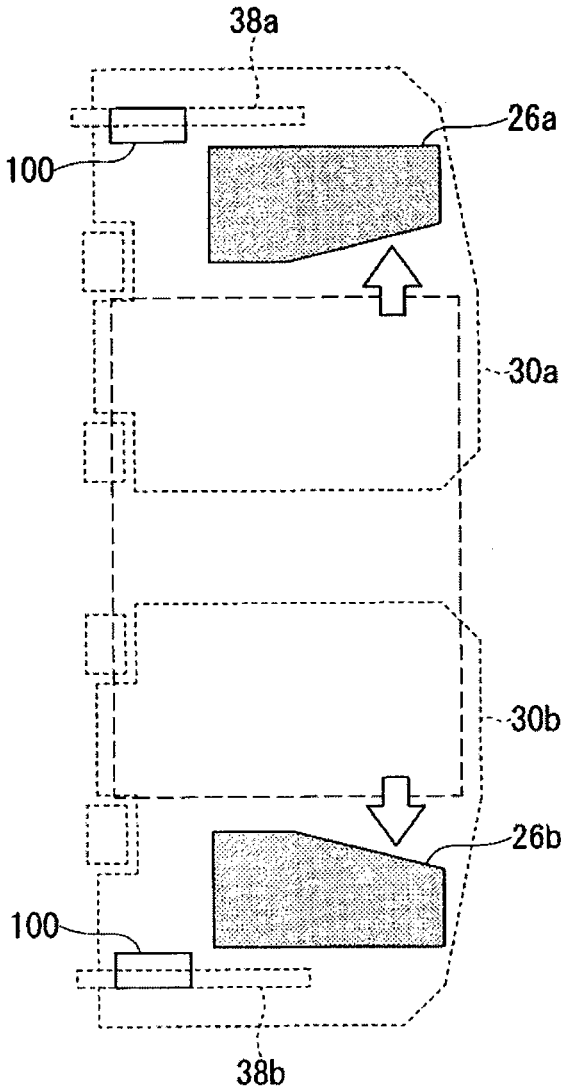
Figure 7D:
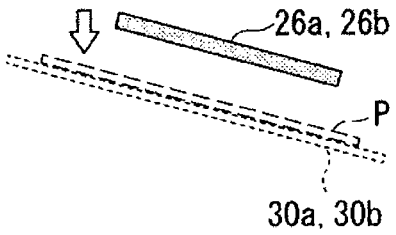

Then, the standby trays 26*a*, 26*b* open to front/rear directions thereafter as illustrated in FIG. 7C, and the sheet P drops to the processing tray 30 (<4>) (FIG. 7D).

Figure 8:
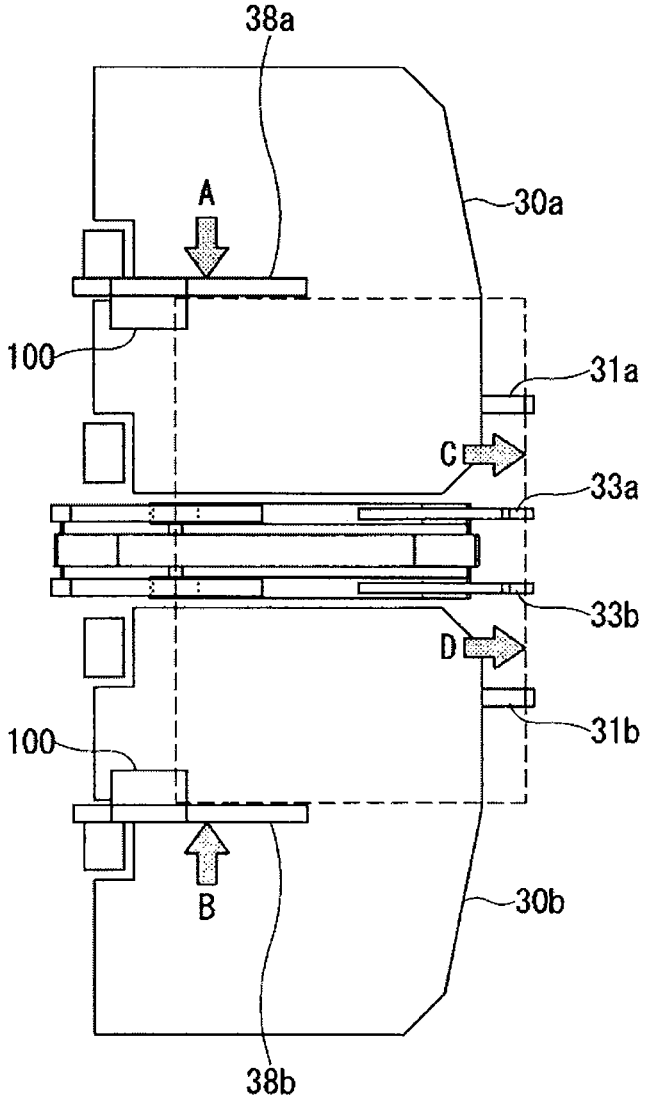
FIG. 8 illustrates an operation of a longitudinal aligning and a side aligning, according to the embodiment.

A predetermined numbers of sheets are loaded on the processing tray 30, and then a longitudinal aligning and a side aligning is conducted as illustrated in FIG. 8. The longitudinal aligning is conducted by rotating the sheet bundle conveying rollers 36 in a direction that is reverse of a direction of ejection, and pressing the back edge of the sheet P towards the back stoppers 31*a*, 31*b* or the ejectors 33*a*, 33*b* (arrows C, D in FIG. 8) by rotating the paddle 28 counterclockwise in FIG. 3 (<5>).

The side alignment is conducted by pressing the side aligning plate 38*a*, 38*b* towards the both edges of the sheet P (arrows A, B in FIG. 8).

Sorting is conducted by offsetting a bundle of sheets to the front side and the rear side alternately for every sheet bundle processed for side aligning, following the longitudinal aligning.

Stapling is conducted using the stapler 40 following the longitudinal aligning and the side aligning.

The sheet P that is sorted and stapled on the processing tray 30 is pressed at the back end by the ejectors 33*a*, 33*b* and moves toward the loading tray 11 on the processing tray 30 <6>). The sheet P is pressed at the back end by the bundle claw 35, ejected from the processing tray 30 and then loaded on the loading tray 11 (<7>).

(3) Bending Restrainer

As described above, when the forward end of a sheet ejected from the processing tray is in contact with the top surface of a sheet loaded on the loading tray, a friction occurs between the forward end of a bundle of sheets being ejected and a sheet on the loading tray. Therefore, the bundle of sheets may bend upwards in a convex state in the middle of ejecting, especially if the bundle of sheets comprises thin and frail sheets or larger size of sheets.

Figure 9A:
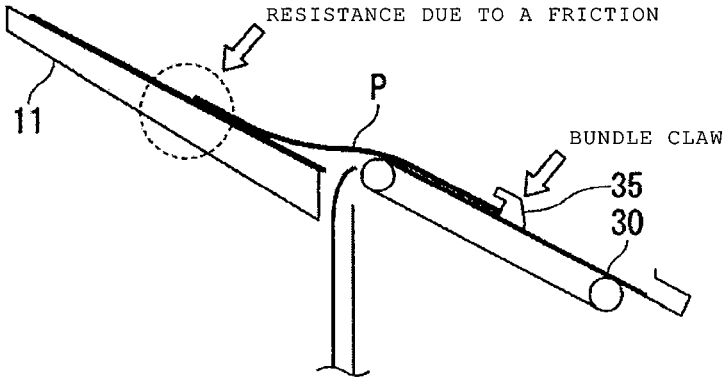
FIG. 9A (PRIOR ART)
FIGS. 9A to 9C illustrate a problem with ejecting sheets in the related art.
Figure 9B:
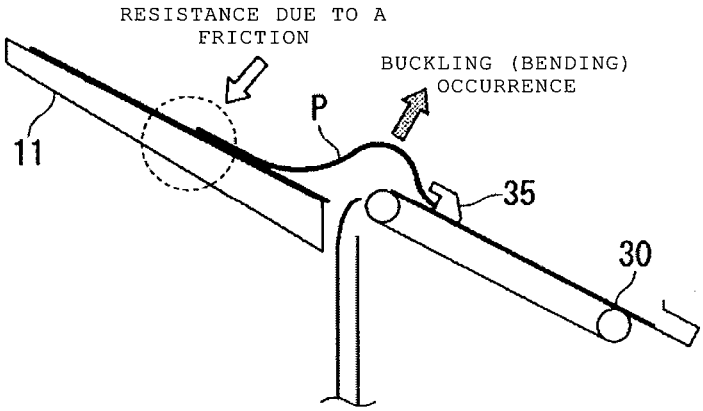
FIG. 9B (PRIOR ART)
Figure 9C:
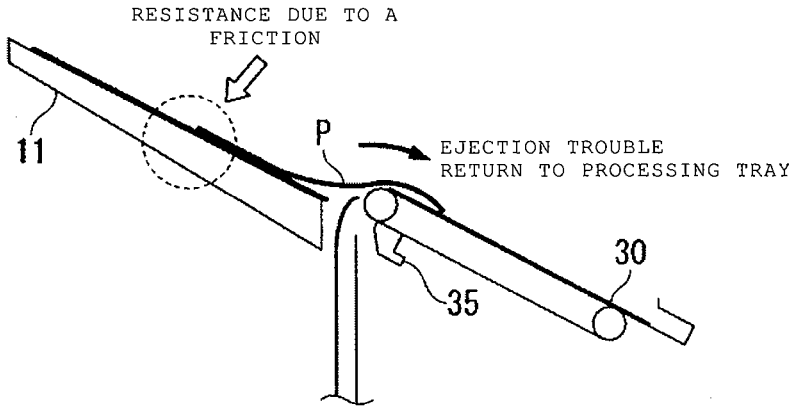
FIG. 9C (PRIOR ART)

FIGS. 9A to 9C illustrate such a problem with ejecting sheets in a conventional sheet processing apparatus. A stapled bundle of sheets P is pushed at the back end by the bundle claw 35 from the processing tray 30 to the loading tray 11, as illustrated in FIG. 9A. At this time, a friction occurs between the forward end of a bundle of sheets P being ejected and a sheet on the loading tray 11. Thus, the bundle of sheets P resist movement in the ejecting direction. Accordingly, a bending (buckling) occurs in the bundle of sheets P as illustrated in FIG. 9B. Once bending occurs, even if the bundle claw 35 moves forward, the pushing force is divided into a force towards conveying direction and a force towards above the bundle of sheets P (i.e., a direction perpendicular to the plane of the bundle of sheets P). The force pushing the bundle of sheets P towards the loading tray 11 becomes weaker. Consequently, an ejection trouble occurs in which the back end of the bundle of sheets P does not reach the loading tray 11 and the back end of the bundle of sheets P goes back to the processing tray 30 even if the bundle claw 35 goes around the forward end of the processing tray 30, as illustrated in FIG. 9C.

According to the present disclosure, this problem may be resolve with a bending restrainer 100 includes a bending restrainer member 120 extending almost parallel to the processing tray 30 with a certain gap so as to cover a portion of the region of the ejecting side of the processing tray 30, thus restraining bending of a bundle of sheets P ejected from the processing tray 30 to the loading tray 11. Such a bending restrainer 100 is provided in the sheet processing apparatus 1 of the present embodiment.

Figure 10A:
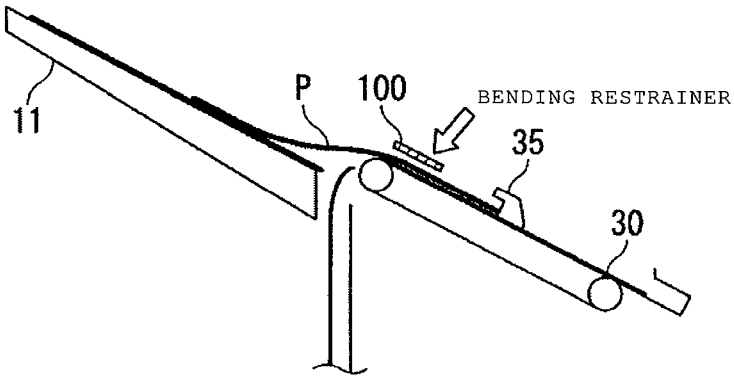
FIGS. 10A to 10C illustrate a position and a functional effect of a bending restrainer, according to the embodiment.
Figure 10B:
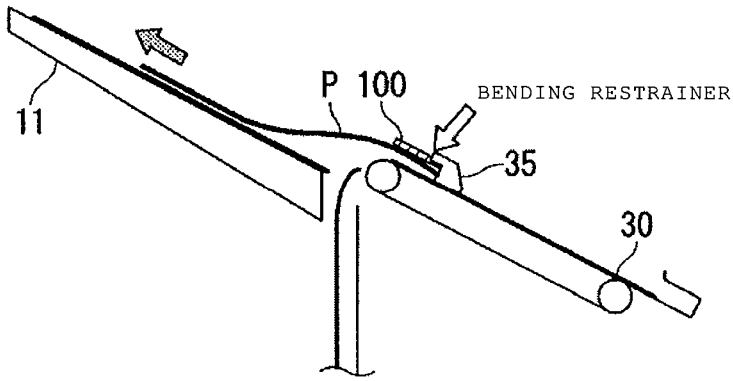
Figure 10C:
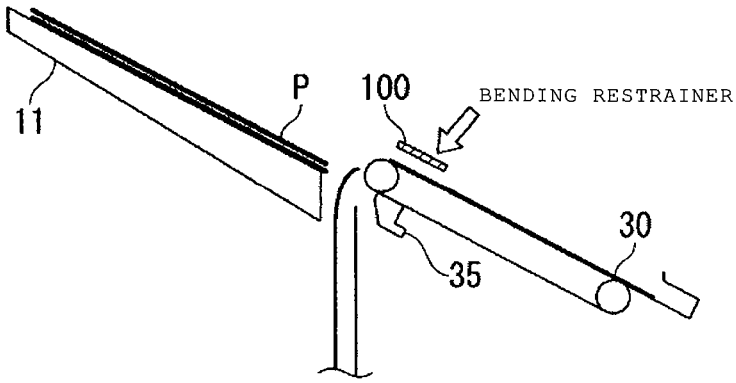

FIGS. 10A to 10C explain a position and a functional effect of the bending restrainer 100. As illustrated in FIG. 10A, a bundle of sheets P is pushed at the back end by the bundle claw 35 and pushed out from the processing tray 30 to the loading tray 11 as similar to the conventional apparatus. While being ejected, the forward end of the bundle of sheets P receives a friction resistance by a sheet on the loading tray 11. The sheet processing apparatus 1 in the present embodiment includes the bending restrainer 100 in the vicinity of the forward end of the processing tray 30. A bundle of sheets P, which encounters the friction resistance, attempts to bend upwards. The bending does not occur because the top surface side of the bundle of sheets P is restrained by the bending restrainer 100, as illustrated in FIG. 10B. Consequently, the pushing force by the bundle claw 35 is not divided towards above the bundle of sheets P, but is instead focused in the conveying direction. Thus the forward end of the bundle of sheets P overcomes the friction and moves smoothly toward the loading tray 11. As illustrated in FIG. 10C, the bundle is loaded on the loading tray 11 in an aligned manner. Accordingly, the previously described ejection trouble is prevented by providing the bending restrainer 100.

As described above, the sheet processing apparatus 1 in the present embodiment has a configuration in which the bundle of sheets P loaded on the standby tray 26 is dropped to the processing tray 30 as described referring FIGS. 6 to 8. Hence, the bending restrainer 100 in the present embodiment is configured to move in a direction perpendicular to the conveying direction of the bundle of sheets P, along with the side aligning plates 38*a*, 38*b*.

FIGS. 11 to 14B illustrate the bending restrainer 100 and a supporting member 110 along with the side aligning plate 38 (38*a*, 38*b*).

Figure 11:
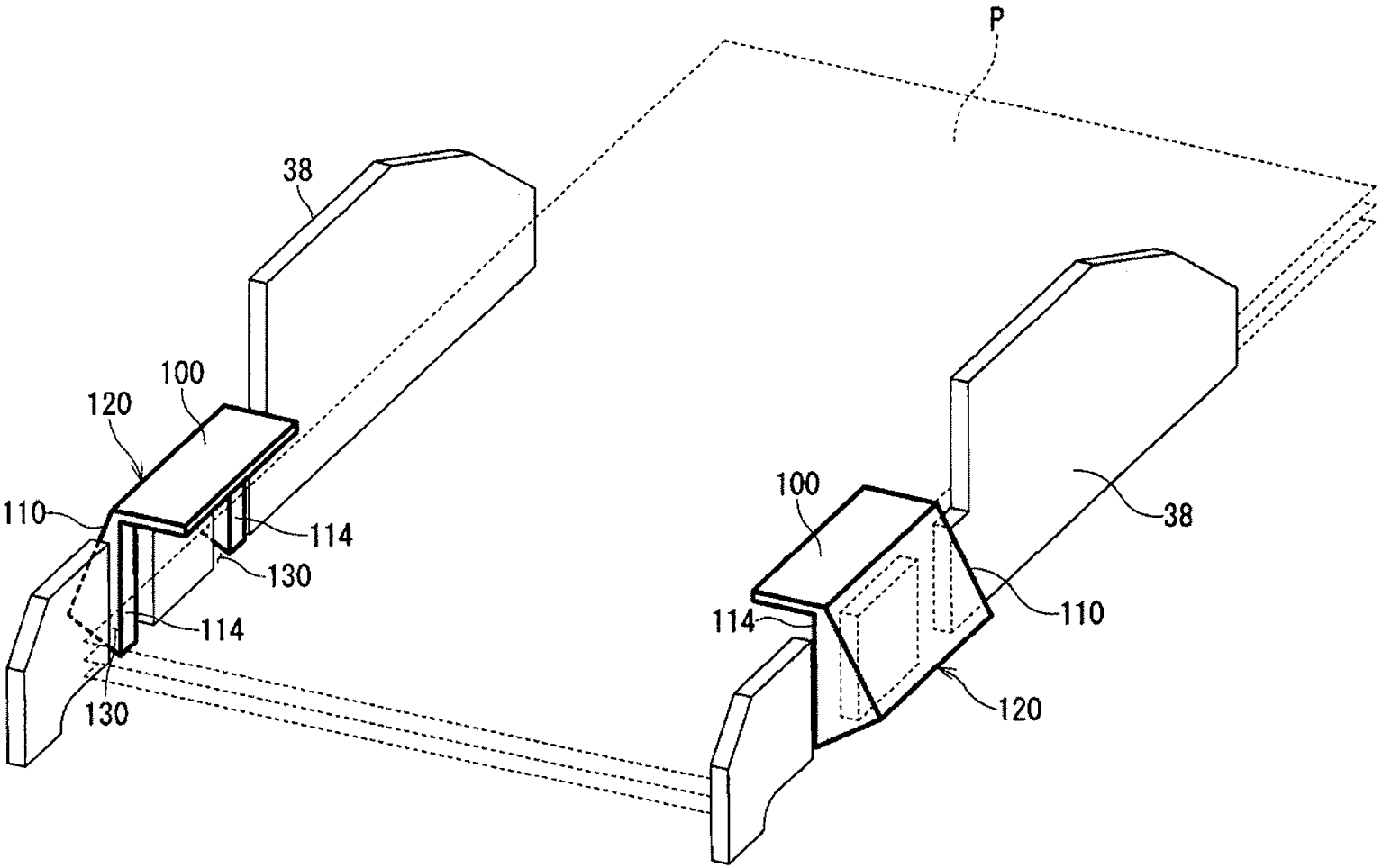
FIG. 11 illustrates the bending restraining member at a horizontal orientation.

As illustrated in FIG. 11 (and others), each bending restrainer 100 includes the plate-shaped bending restrainer member 120 extending from the supporting member 110. The supporting member 110 is rotatably supported by a shaft 112 to the side aligning plate 38 as illustrated in FIGS. 13A to 13C and 14A and 14B. In addition, two contacting ribs 114 extend from the supporting member 110 toward the inside of the processing tray 30.

The bending restraining member 120 moves between two positions—a horizontal orientation and an inclined orientation—depending on the position of the side aligning plate 38. The horizontal orientation is an orientation when the side aligning plate 38 contacts the side edge of the bundle of sheets P as illustrated in FIG. 11 (also ref. FIG. 13C). The bending restrainer member 120 is almost horizontal against the loading plane of the processing tray 30 in the horizontal orientation. In the horizontal orientation, the edge planes of the contacting ribs 114 are almost at the same position as the side aligning plate 38. Thus the planes contact the side edges of the bundle of sheets P and become perpendicular to the processing tray 30.

Figure 12:
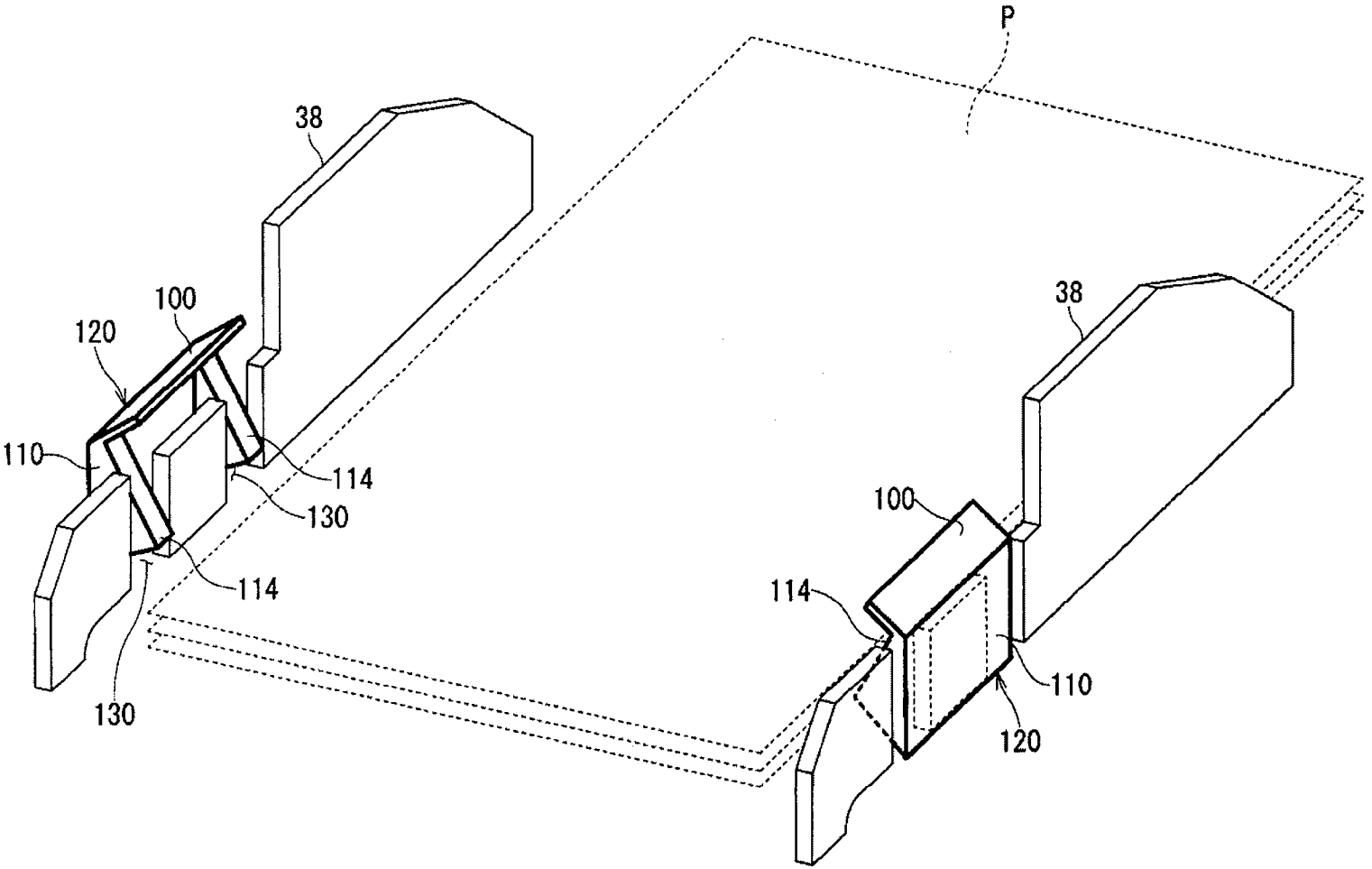
FIG. 12 illustrates the bending restraining member at an inclined orientation, according to the embodiment.
Figure 13A:
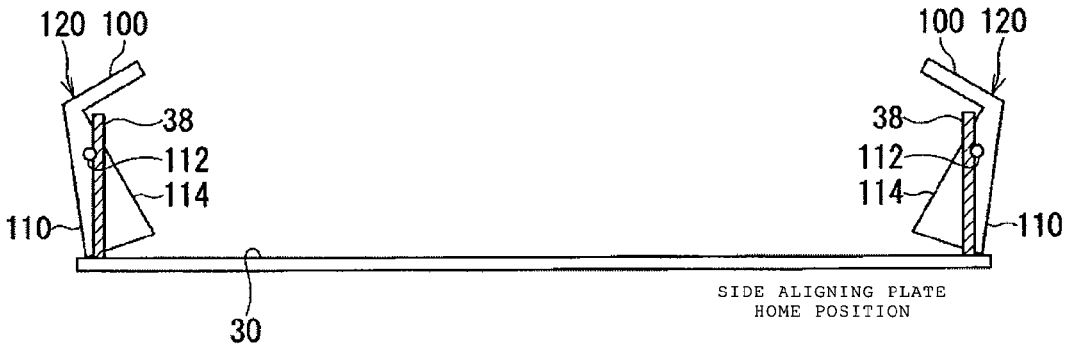
FIGS. 13A to 13C illustrate example operations of a bending restraining member and a side aligning plate, according to the embodiment.
Figure 13B:
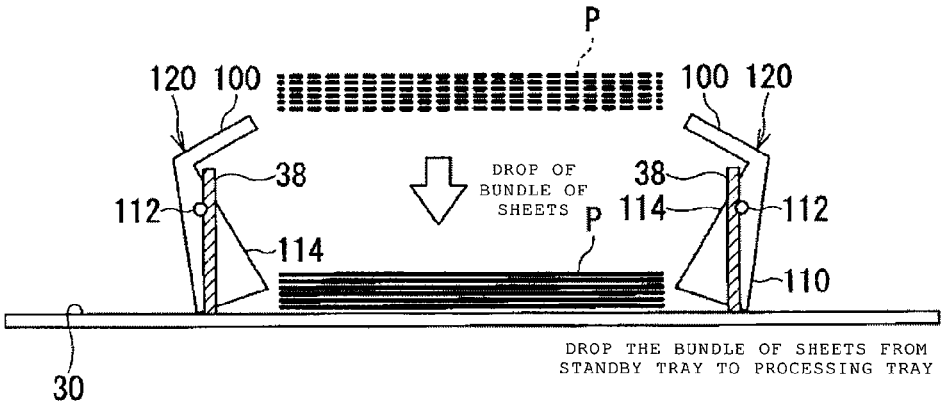
Figure 13C:
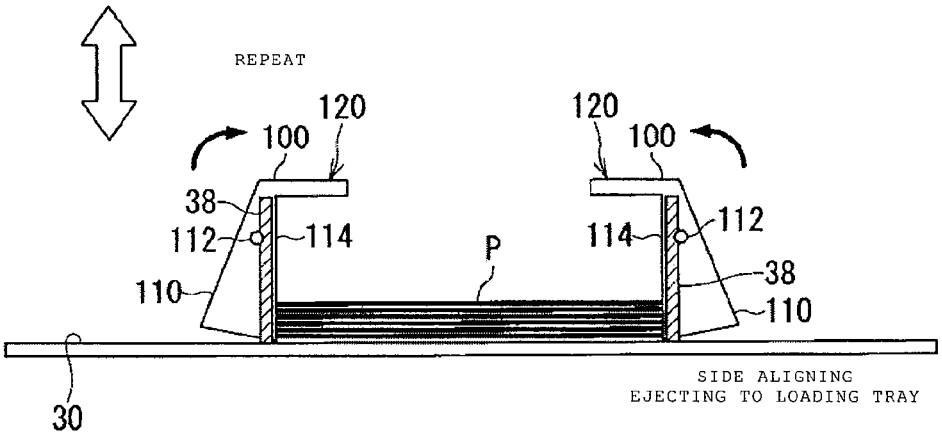

In contrast, the inclined orientation is an orientation when the side aligning plate 38 is away from the side edge of the bundle of sheets P, as illustrated in FIG. 12 (also see FIGS. 13A, 13B). The bending restrainer member 120 inclines obliquely upward against the loading plane of the processing tray 30 in the inclined orientation. A portion of the contacting rib 114 passes through a opening 130 provided on the side aligning plate 38 and extends toward the inside of the processing tray 30. The edge plane of the contacting rib 114 becomes inclined with respect to the processing tray 30.

A movement and a functional effect of the bending restraining member 120 is further described with reference to FIGS. 13A to 13C. FIGS. 13A to 13C are all end views looking at the processing tray 30, the side aligning plate 38, and the bending restraining member 120 from the ejection side of the loading tray 11.

FIG. 13A illustrates a state in which the side aligning plates 38 are at the both sides of the processing tray 30, namely at the home position. In this state, the bending restraining member 120 is at the inclined orientation. The left and right bending restrainers 100 incline obliquely upward. Also, the contacting ribs 114 of the supporting member 110 extend through the opening 130 of the side aligning plates 38 (see FIG. 12) and protrude toward the inside of the processing tray 30.

Upon initiating the ejecting operation of the sheet processing apparatus 1, the side aligning plate 38 migrates toward the inside of the processing tray 30 by a not-shown motor and a driving mechanism, and then stops at the position shown in FIG. 13B. At this point, the bending restraining member 120 maintains the inclined orientation. The stopping position is determined to be a position in which the inclined bending restrainer does not prevent dropping of the bundle of sheets P, when the bundle of sheets P drops from the standby tray 26 to the processing tray 30. The bundle of sheets P is dropped from the standby tray 26 to the processing tray 30, when the side aligning plate 38 stops at the position indicated in FIG. 13B.

Following the dropping of the bundle of sheets P to the processing tray 30, the bundle of sheets P is pressed toward the stoppers 31*a*, 31*b* and the ejectors 33*a*, 33*b* located at the back of the processing tray 30 and aligned longitudinally.

After that, as illustrated in FIG. 13C, the side aligning plate 38 migrates further toward the inside of the processing tray 30. Then side aligning of the bundle of sheets P is conducted such that the side aligning plates 38 press the side edges of the bundle of sheets P from both sides.

At this time, the edge plane of the contacting ribs 114 of the supporting member 110, which is protruding from the opening 130 of the side aligning plates 38, also presses the side edges of the bundle of sheets P. The supporting member 110 is rotatably supported by the rotating shaft 112 and attached to the side aligning plate 38. Thus, upon aligning the side, the bending restrainer 100 rotates around the rotating shaft 112 in a direction of the arrow in FIG. 13C and the bending restrainer member 120 becomes parallel to the loading surface of the processing tray 30. In other words, the bending restrainer 100 moves to the horizontal orientation at the time of side aligning. The bundle of sheets P is stapled following side aligning, and then the bundle of sheets P is ejected from the processing tray 30 to the loading tray 11 by the ejectors 33*a*, 33*b* or bundle claw 35. During stapling and ejection, the bending restrainer 100 maintains the horizontal orientation. That is, the bending restraining member 120 maintains the state of extending horizontally with a certain gap with respect to the processing tray 30 so as to cover the both sides of the bundle of sheets P, when the bundle of sheets P is ejected to the loading tray 11. Consequently, as illustrated in FIG. 10B, bending upward due to a friction at the forward end of the bundle of sheets P is restrained by the bending restrainers 100 at both sides. Thus the ejection trouble accompanied with bending can be prevented.

Upon ejecting the bundle of sheets P to the loading tray 11, contact between the edge planes of the contacting ribs 114 and the bundle of sheets P is released and the bending restrainer 100 returns from the horizontal orientation to the inclined orientation. A transition from the horizontal orientation to the inclined orientation can be conducted by the weight of the bending restrainer 100 itself. In a preferred configuration, a biasing force of an elastic member is used, so as to prevent an unstable vibration associated with the migration of the side aligning plate 38.

Figure 14A:
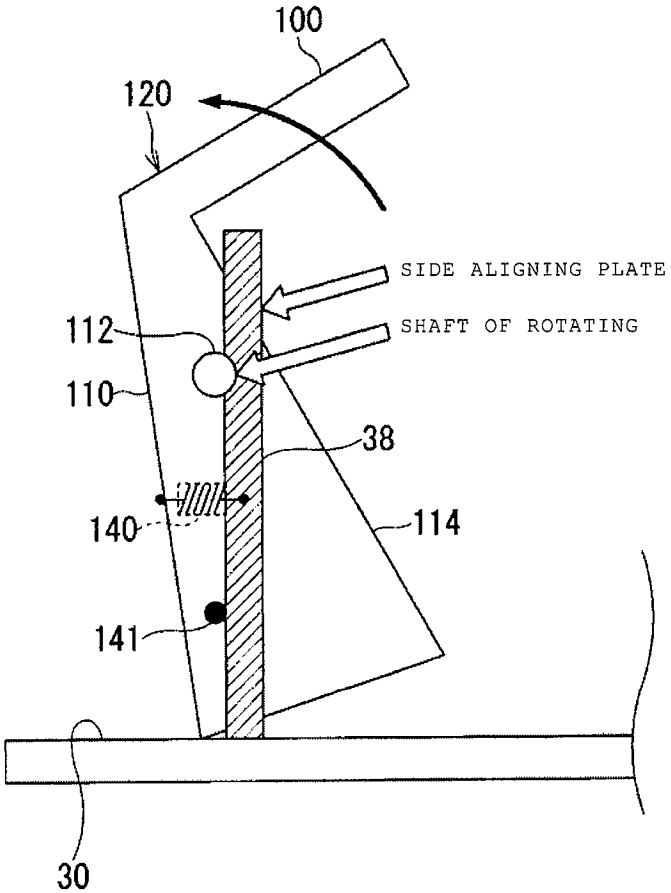
FIGS. 14A and 14B illustrate a configuration in which a horizontal orientation and an inclined orientation of the bending restraining member are switched by a biasing force of a spring, according to the embodiment.
Figure 14B:
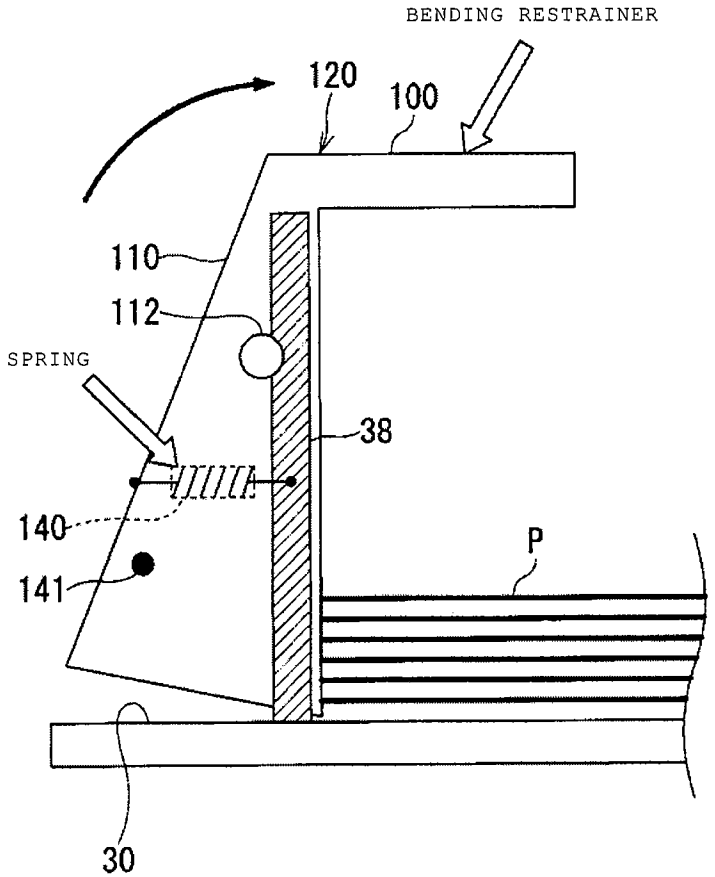

FIGS. 14A and 14B illustrate a method of biasing using a tension spring 140 as an example of the elastic member. As illustrated in FIGS. 14A and 14B, both ends of the tension spring 140 are anchored to an appropriate location, for instance, between the supporting member 110 and the side aligning plate 38. Biasing force by the tension spring 140 acts around the rotating shaft 112 (counterclockwise in FIGS. 14A, 14B). However, the bending restraining member 120 maintains the inclined orientation by an appropriate stopper 142 provided on the supporting member 110, when the contacting ribs 114 are not in contact with the bundle of sheets P (FIG. 14A).

On the other hand, when side aligning by the side aligning plate 38 is conducted, the contacting ribs 114 of the supporting member 110 press the bundle of sheets P, and this pressing force acts against the biasing force of the tension spring 140, The bending restrainer 100 is then rotated clockwise around the rotating shaft 112 and changes the bending restraining member 120 from the inclined orientation to the horizontal orientation. The bending restraining member 120 returns from the horizontal orientation to the inclined orientation by biasing force of the tension spring 140, because pressing force between the contacting rib 114 and the bundle of sheets P no longer acts when the bundle of sheets P is ejected from the processing tray 30 to the loading tray 11.

The side aligning plate 38 returns to the stop position as shown in FIG. 13B thereafter and the plate receives the bundle of sheets P dropping from the standby tray 26 to the processing tray 30. An operation illustrated in FIGS. 13B and 13C will be repeated when continuously processing a plurality of the bundle of sheets P.

Although the inclined orientation and the horizontal orientation of the bending restraining member 120 are switched according to the position of the side aligning plate 38 in the above description, it can be fixed to a horizontal orientation only. In such a case, a stop position of the side aligning plate 38 needs to be further away toward the home position side than the position shown in FIG. 13B so as not to interfere the drop of the bundle of sheets P by the bending restrainer 100, because the bending restrainer 100 is fixed with the horizontal orientation. Therefore, throughput diminishes slightly in case a plurality of the bundle of sheets P is continuously processed. However, the effect itself—preventing an ejection trouble such as bending of the bundle of sheets P at the time of ejection to the loading tray 11—can be obtained as similar to the previous embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

a processing tray configured to receive sheets to be processed, the processing tray having an ejecting side from which sheets are ejected;

a loading tray provided downstream from the processing tray in a sheet ejecting direction and configured to receive sheets ejected from the processing tray; and a bending restrainer including a restraining member configured to rotate relative to the processing tray between a first position, in which the restraining member extends almost parallel to the processing tray and covers a portion of the ejecting side of the processing tray, and a second position in which the restraining member does not cover the portion of the ejecting side of the processing tray, the restraining member further configured to restrain bending of sheets ejected from the processing tray to the loading tray when the restraining member is in the first position.

2. The sheet processing apparatus according to claim 1, further comprising:

a side aligning plate configured to align sides of sheets loaded on the processing tray and to move in a direction perpendicular to the sheet ejecting direction, wherein the bending restrainer is movable together with the side aligning plate in the direction perpendicular to the sheet ejecting direction.

3. The sheet processing apparatus according to claim 2, further comprising:

a standby tray configured to temporarily receive sheets to be processed and then to drop the sheets to the processing tray, wherein, when the bending restrainer is in the second position, the sheets are not prevented from being received on the processing tray when the sheets drop from the standby tray to the processing tray.

4. The sheet processing apparatus according to claim 3, wherein:

the bending restrainer includes a supporting member that is rotatably supported on the side aligning plate, wherein when the side aligning plate contacts a sheet on the processing tray to align its side, the supporting member contacts the sheet and rotates so that the restraining member is in the first position and is parallel to the processing tray in a position covering a portion of the processing tray, and when the side aligning plate separates from the sheet, the supporting member rotates and causes the bending restrainer to move to the second position such that the sheets are not prevented from being received on the processing tray when the sheets drop from the standby tray to the processing tray.

5. The sheet processing apparatus according to claim 4, wherein:

the supporting member is biased by an elastic member around an axis of rotation.

6. The sheet processing apparatus according to claim 1, wherein:

the bending restrainer comprises a first bending restrainer disposed on a first side of the processing tray and a second bending restrainer disposed on a second side of the processing tray.

7. The sheet processing apparatus according to claim 6, wherein:

a gap extends between the first bending restrainer and the second bending restrainer in a direction perpendicular to the sheet ejecting direction.

8. A method for ejecting a sheet bundle comprising:

receiving the sheet bundle on a processing tray;

processing the sheet bundle according to a predetermined process;

ejecting the sheet bundle from the processing tray to a loading tray while preventing an upward bending of the sheet bundle with a restraining member in a first position extending substantially parallel to the processing tray and covering a portion of the electing side of the processing tray; and rotating the restraining member relative to the processing tray from the first position to a second position in which the restraining member does not cover the portion of the ejecting side of the processing tray.

9. The method according to claim 8, further comprising:

aligning sides of the sheet bundle on the processing tray by moving a side aligning plate in a direction perpendicular to a sheet ejecting direction, wherein the restraining member moves together with the side aligning plate in the direction perpendicular to the sheet ejecting direction.

10. The method according to claim 9, further comprising:

temporarily receiving sheets that form the sheet bundle on a standby tray;

dropping the sheet bundle to the processing tray when the restraining member is in the second position such that the sheet bundle is not prevented from being received on the processing tray when the sheet bundle drops from the standby tray to the processing tray.

11. The method according to claim 10, further comprising:

rotating the restraining member from the second position to the first position.

12. The method according to claim 11, wherein moving the retraining member to the second position comprises rotating the restraining member from the first position to the second position.

13. The method according to claim 11, wherein:

the restraining member is biased towards the second position.

14. The method according to claim 8, wherein:

the restraining member comprises a first restraining member disposed on a first side of the processing tray and a second restraining member disposed on a second side of the processing tray.

15. The method according to claim 14, wherein:

a gap extends between the first restraining member and the second restraining member in a direction perpendicular to a sheet ejecting direction.

16. A sheet processing apparatus comprising:

a processing tray configured to receive sheets to be processed, the processing tray having an ejecting side from which sheets are ejected;

a loading tray provided downstream from the processing tray in a sheet ejecting direction, configured to receive sheets ejected from the processing tray;

a standby tray configured to temporarily receive sheets to be processed and then to drop the sheets to the processing tray; and a bending restrainer configured to rotate relative to the processing tray between a first position in which the bending restrainer restrains bending of sheets ejected from the processing tray to the loading tray and a second position in which sheets are not prevented from being received on the processing tray when the sheets drop from the standby tray to the processing tray.

17. The sheet processing apparatus according to claim 16, further comprising:

a side aligning plate configured to align sides of sheets loaded on the processing tray and to move in a direction perpendicular to the sheet ejecting direction, wherein the bending restrainer is movable together with the side aligning plate in the direction perpendicular to the sheet ejecting direction.

18. The sheet processing apparatus according to claim 17, wherein:

when the side aligning plate contacts a sheet on the processing tray to align its side, the bending restrainer is in the first position, and when the side aligning plate separates from the sheet, bending restrainer moves from the first position to the second position.

19. The sheet processing apparatus according to claim 16, wherein:

the bending restrainer is biased towards the second position by a biasing member.

20. The method according to claim 16, wherein:

the restraining member comprises a first restraining member disposed on a first side of the processing tray and a second restraining member disposed on a second side of the processing tray.

* * * * *